United States Patent [19]

De Howitt

[11] Patent Number: 4,612,150

[45] Date of Patent: Sep. 16, 1986

[54] PROCESS FOR COMBINING AND CODRAWING ANTISTATIC FILAMENTS WITH UNDRAWN NYLON FILAMENTS

[75] Inventor: Jack R. De Howitt, Camden, S.C.

[73] Assignee: E. I. Du Pont de Nemours and Company, Wilmington, Del.

[21] Appl. No.: 555,513

[22] Filed: Nov. 28, 1983

[51] Int. Cl.[4] ..... D02G 3/12

[52] U.S. Cl. ..... 264/103; 264/105; 264/171; 264/210.2; 264/210.8; 264/289.3; 264/290.5; 57/245; 57/901

[58] Field of Search ..... 264/103, 105, 210.8, 264/171, 210.2, 289.3, 290.5; 57/205, 208, 245, 901

[56] References Cited

U.S. PATENT DOCUMENTS

| | | | |
|---|---|---|---|
| 2,936,482 | 5/1960 | Kilian | 425/463 |
| 2,989,798 | 6/1961 | Bannerman | 264/78 |
| 3,186,155 | 6/1965 | Breen et al. | 264/DIG. 47 |
| 3,969,559 | 7/1976 | Boe | 428/97 |
| 4,069,657 | 1/1978 | Bascon et al. | 264/103 |

FOREIGN PATENT DOCUMENTS

| | | | |
|---|---|---|---|
| 0025893 | 3/1978 | Japan | 105/ |

*Primary Examiner*—Donald Czaja
*Assistant Examiner*—Hubert C. Lorin

[57] ABSTRACT

Electrically conductive and nonconductive filaments are combined in a quench chimney and then codrawn and cobulked prior to wind-up.

4 Claims, 2 Drawing Figures

PROCESS FOR COMBINING AND CODRAWING ANTISTATIC FILAMENTS WITH UNDRAWN NYLON FILAMENTS

BACKGROUND OF THE INVENTION

Windley U.S. Pat. No. 3,971,202 describes the cobulking of electrically conductive sheath-core filaments such as are disclosed in Hull, U.S. Pat. No. 3,803,453, with nonconductive filaments to form a composite yarn. The conductive filaments are melt-spun at a rate of about 890 yards per minute, ypm, (meters per minute, mpm) and then drawn at least about 2.0× on a draw twister, to increase tenacity. The strength is needed for subsequent processing, e.g., in the hot cobulking jet with the nonconductive fibers. The separately drawn conductive and nonconductive filaments are then combined on a roll in a hot chest where they are annealed to reduce shrinkage and then the combined yarns are cobulked.

Unfortunately, conductive filament breaks occur frequently at or about the location where the filaments are combined. Further, cross-overs of the conductive filaments between ends of nonconductive filaments on the roll take place thereby reducing the proportion of first quality product that is obtained. The solution to these problems has been a desirable objective.

SUMMARY OF THE INVENTION

In accordance with the present invention, there is provided a process for producing a carpet yarn with reduced static propensity comprising melt spinning a plurality of nonconductive nylon filaments into a quench chimney, pneumatically introducing spin-oriented electrically conductive bicomponent filaments into the freshly spun threadline within the quench chimney, consolidating the combined yarn at a puller roll, drawing and cobulking the combined yarn and then winding up the yarn.

THE DRAWINGS

DETAILED DESCRIPTION OF THE DRAWING

The process of the present invention provides a carpet yarn with reduced static propensity. The yarn is made up of conductive bicomponent filaments in an amount of less than about 10 wt %, preferably from 1 to 10 wt %, with the remainder being nonconductive filaments.

It is desirable that the conductive filaments be as thin as possible, i.e., of low denier. The conductive filaments containing a polymer component having carbon black to provide electrical conductivity, generally have a dark appearance and thin dark filaments are less conspicuous to the eye. The thin filaments also provide an economic advantage since the level of antistatic performance is not comparably reduced, with denier reduction, i.e., the thinner filaments retain most of the antistatic capabilities of the thicker filaments, in spite of the fact that less conductive material is used.

The conductive filaments used in this invention are prepared by high speed spinning of bicomponent filaments as described below. The preferred bicomponent filaments are sheath/core, i.e., where the nonconductive component fully encapsulates a conductive core and this specification will describe their preparation in detail. However, filaments as described by Boe U.S. Pat. No. 3,969,559 wherein the nonconducting component (or constituent) encapsulates or surrounds more than 50% but less than all of the conducting component are also included, although less preferred because of limitations on the types of conductive material that may be employed and for other reasons.

The sheath component polymers that may be used for the conductive filaments of the present invention are the same as those disclosed in the Hull patent, supra. Titanium dioxide, while not necessary for this invention is added conventionally to the sheath as a delusterant and to improve hiding of the core. Substantially greater amounts of $TiO_2$ than disclosed in Hull may be added to the sheath polymer, if desired. The preferred sheath polymer is a polyamide e.g. polyhexamethylene adipamide. The core component materials that may be used are the same as those disclosed by Hull and may be prepared similarly. The preferred core polymer is a polyolefin, most preferably, polyethylene. The core polymer should contain between 15 and 50% by wt of the electrically conductive carbon black dispersed therein. Preferably, the core will constitute less than 10% by volume of the conductive filament.

The materials useful for preparing the bicomponent filaments wherein the nonconductive component encapsulates more than 50% of the conductive component are taught in Boe, supra, and are similar to those of Hull. The Boe patent also describes a process for making the filaments.

Figure 1:
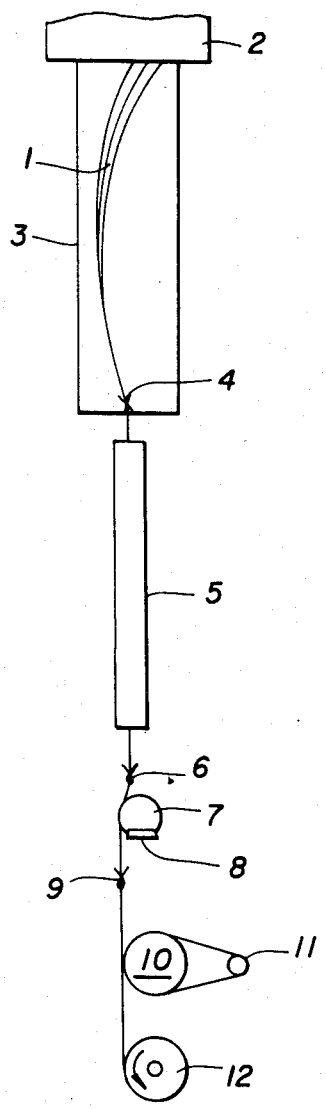
FIG. 1 is a schematic of a preferred process for making the conductive yarn which is used in the process of this invention.

Spinning of the sheath/core filaments useful in this invention is accomplished as shown in FIG. 1. The core and sheath materials of filaments 1 are extruded from a spinneret assembly 2 into quench chimney 3 and are cross-flow quenched by room-temperature air flowing from right to left. After cooling to a non-tacky state, the filaments are converged into a yarn by guide 4 and pass through steam conditioner tube 5, through guide 6, over finish roller 7 immersed in finish bath 8 through guide 9, then wrapped around high-speed puller roll 10 and associated roller 11, and are wound up as package 12 in a manner similar to Hull, except that the filaments are attenuated by pulling the filaments away from the quenching zone as shown in Adams U.S. Pat. No. 3,994,121, at a speed of at least 800 ypm (732 mpm), preferably between 1250 and 1500 ypm (1143 and 1372 mpm). The spinning speed is the speed at which the yarn leaves the quenching zone and is equivalent to the peripheral speed of the puller or feed rolls. The spinning speed is adjusted to produce filaments having a preferred denier from about 6 to 11. The resulting filaments are characterized by having a tenacity of from about 1 to 3 gpd, an elongation of between 200 and 500%. As for those bicomponent filaments in which the nonconducting component only partially encapsulates the conducting component a similar extrusion process to that in Boe may be employed and the filaments attenuated by pulling from the quenching zone at the appropriate speed.

DESCRIPTION OF THE TEST PROCEDURES

All measurements, test procedures and terms referred to herein, e.g., RV, T, E, and D, are as defined and described in the aforementioned Windley, Hull and Adams patents.

EXAMPLE 1

Sheath Composition

Polyhexamethylene adipamide containing 0.3% rutile $TiO_2$ and Mn $(H_2PO_2)_2$ (9 ppm Mn), is prepared with agitation in an autoclave to insure good $TiO_2$ dispersion in polymer. The polymer has a relative viscosity (RV) of 40.

Core Composition

A polyethylene resin (Alathon 4318, density—0.916, melt index—23 ASTM-D-1238, 50 ppm antioxidant, manufactured by Du Pont) is combined with electrically conductive carbon black in the ratio 71.55 resin to 28.2 carbon black by weight with 0.25% by weight Antioxidant 330 (Ethyl Corporation 1,3,5-trimethyl-2,4,6-tris(3,5-ditertiarybutyl-4-hydroxybenzyl)benzene. The carbon black is Vulcan XC-72 available from the Cabot Corporation, Boston, Mass. The carbon black dispersion is compounded in a Banbury mixer, extruded, filtered and pelletized. The pellets are remelted, extruded and filtered through filter media retaining 31 micron particulates, and pelletized. Specific resistance, measured as described by Hull U.S. Pat. No. 3,803,453, is less than 10 ohm-cm.

Spinning of The Conductive Yarn

The polymers are spun using a spinneret assembly to spin concentric sheath core filaments by the technique shown in U.S. Pat. Nos. 2,936,482 and 2,989,798.

The sheath polymer is melted at 285° C. at atmospheric pressure and is fed to a pack filter at a rate of 32.9 gm/min.

The core polymer containing 1% moisture is melted in a screw melter. Molten polymer is fed through a filter pack at a rate of 1.4 gm/min.

The spinning block temperature is 285° C. The core polymer supply hopper is purged with dry inert gas.

The RV of sheath polymer coming from the spinneret is about 47, the increased RV resulting from further polymerization of nylon while being melted.

Antistatic filaments are obtained by extruding the molten polymer materials from a spinneret with 24 capillaries. The extruded filaments pass through a 45 in long chamber where they are cross-flow quenched with room temperature air. They then contact guides which converge them into yarns each containing three filaments. To improve yarn windup, the yarns are passed into a 78 in long steam conditioning tube (see Adams U.S. Pat. No. 3,994,121, Ex. I) into which 1.8 psig steam is introduced from two 0.04 in orifices near the top of the tube and one 0.050 in orifice near the center of the tube.

Finish is then applied to the yarn. The yarn is spun at a feed roll speed of 1250 ypm (1143 mpm) and the yarn is packaged at 4.4 gms/denier tension.

The three-filament yarns which have been oriented by spinning, hence "spin-oriented", are characterized by having a tenacity of 1.8 gm/den and an elongation of 300%. Denier was 33. Precent core is 2% by volume. Percent sheath is 98%.

Preparation of Carpet Yarn

Figure 2:
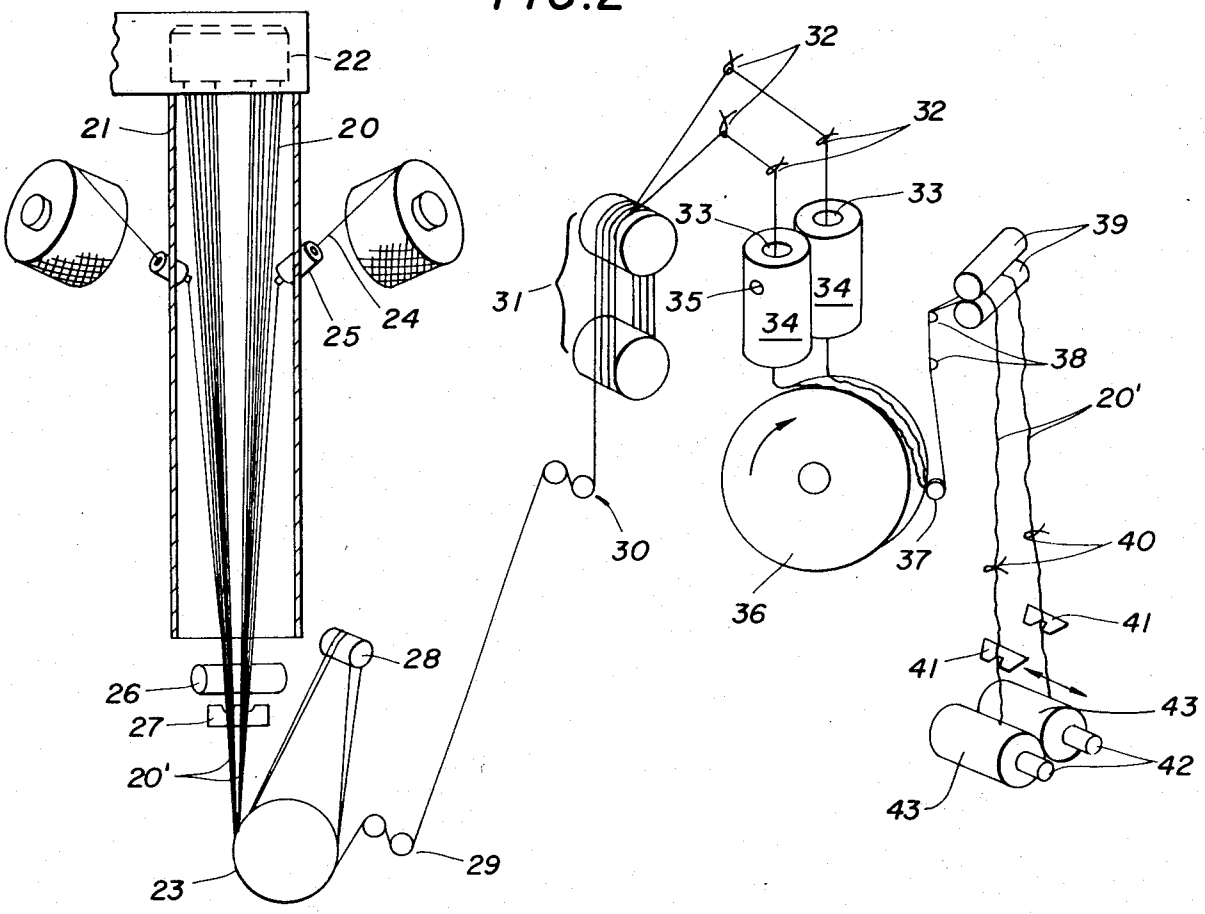
FIG. 2 is a schematic of the process of the invention where a spin-oriented conductive bicomponent yarn is combined with a freshly spun, undrawn nonconductive yarn in the quench chimney before reaching the puller or feed roll and the combined yarn is forwarded to draw rolls, then cobulked and delivered for packaging.

The preparation of the carpet yarn will be best understood with reference to FIG. 2. Several ends of the conductive yarn described above are combined with an undrawn nonconductive yarn threadline at a location prior to the puller roll and the combined yarn then drawn, annealed and bulked as follows:

FIG. 2 shows production of two ends of carpet yarn. In this figure, polyhexamethylene adipamide (72 RV) for the nonconductive yarns (80 filaments per end) is melt spun at 295°-300° C. into a quench chimney 21 where a cooling gas is blown past the hot filaments 20 at 370 scfm (10.5 $m^3$/m). The filaments are pulled from the spinneret 22 and through the quench zone by means of a puller or feed roll 23 rotating at 860 ypm (786 mpm). The conductive yarns 24 described above fed from packages are directed by a gaseous stream via forwarding jet 25 fed with air at 30 psig (206.9 kPa gauge) into the nonconductive threadlines approximately 2 feet (0.6096 m) below the spinneret and become part of the threadlines as they travel to the feed roll. After the conductive yarn reaches feed roll 23 air to the forwarding jet is discontinued. After quenching, the integral threadlines 20' are each converged and treated with finish by contacting finish roller 26 which is partially immersed in a finish trough (not shown). Proper contact with the finish rollers is maintained by adjustment of "U" guides 27. Next, the threadlines pass around the feed roll 23 and its associated separator roll 28 around draw pin assembly 29, 30 to draw rolls 31 (internally heated to produce a surface temperature of 208° C.) rotating at 2580 ypm (2359 mpm) which are enclosed in a hot chest (not shown), where they are forwarded by the rolls 31 at a constant speed through yarn guides 32 and through the yarn passageways 33 of the jet bulking devices 34. In the jets 34, the threadlines 20' are subjected to the bulking action of a hot air (220° C.) directed through inlets 35 (only one shown). The hot fluid exhausts with the threadlines against a rotating drum 36 having a perforated surface on which the yarns cool to set the crimp. From the drum, the threadlines in bulky form pass to a guide 37 and in a path over a pair of guides 38 then to a pair of driven take-up rolls 39. Bulky yarns of this type are disclosed in U.S. Pat. No. 3,186,155 to Breen and Lauterbach. The threadlines 20' are then directed through fixed guides 40 and traversing guides 41 onto rotating cores 42 to form packages 43. Each end of the carpet yarn is 1220 denier (1332 dtex) and contains 83 filaments.

Two other processes are described below as controls A and B. In A, the conductive filaments are combined with the nonconductive filaments on the hot rolls as shown in U.S. Pat. No. 3,971,202. In B, the conductive filaments are combined with the nonconductive filaments at the draw pin. The level of filament breaks on the package of combined yarn in the process of the invention was only 7% of that of process A and only 10% of that of process B. Also, the number of gained and lost filaments for the process of the invention was 0 per 100,000 lbs. of yarn, vs. 3 for process A and 2 for process B. Gained and lost filaments occur when the conductive filaments of one combined yarn running adjacent another on equipment migrate to the other yarn leaving one yarn with no conductive filaments and the other with twice as many as desired. Also, the level of static protection (shuffle voltage measured by AATCC Text Method 134—1979 version) of carpets from yarns of the invention was about the same (between about 2 and 3 kV) as that of processes A and B even though the conductive filaments are drawn, 3.26X along with the nonconductive filaments. This is surprising in view of the teachings of U.S. Pat. No. 4,085,182 at column 1, line 24–25, and at column 2, line 15–17.

The new process provides a reduced consumption of the more expensive conductive fiber while still achieving adequate static protection levels.

I claim:

1. A process for producing a carpet yarn with reduced static propensity comprising melt spinning a plurality of nonconductive nylon filaments into a quench chimney, pneumatically introducing spin-oriented electrically conductive bicomponent filaments into the freshly spun threadline within the quench chimney, consolidating the combined yarn at a puller roll, drawing and cobulking the combined yarn and then winding up the yarn.

2. The process of claim 1 wherein the electrically conductive bicomponent filaments have a synthetic thermoplastic fiber-forming polymer component that encapsulates more than 50% of the conductive core component, the latter comprising a synthetic thermoplastic polymer containing electrically conductive carbon black dispersed therein.

3. The process of claim 2 wherein the component that encapsulates the core is nylon.

4. The process of claim 1 wherein the bicomponent filaments are introduced in an amount of from 1 to 10 wt % of the combined yarn.

* * * * *